US010531186B1

(12) United States Patent
Litovsky et al.

(10) Patent No.: US 10,531,186 B1
(45) Date of Patent: Jan. 7, 2020

(54) ACOUSTIC DEVICE

(71) Applicant: Bose Corporation, Framingham, MA (US)

(72) Inventors: Roman N. Litovsky, Newton, MA (US); Michael Tiene, Franklin, MA (US); Chester S. Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/032,420

(22) Filed: Jul. 11, 2018

(51) Int. Cl.
*H04R 1/10* (2006.01)
*H04R 1/34* (2006.01)
(Continued)

(52) U.S. Cl.
CPC ..... *H04R 1/345* (2013.01); *G10K 11/26* (2013.01); *H04R 1/1091* (2013.01); *H04R 3/04* (2013.01); *H04R 3/12* (2013.01)

(58) Field of Classification Search
CPC ..... H04R 1/345; H04R 1/1091; H04R 3/04; H04R 3/12; G10K 11/26
(Continued)

(56) References Cited

U.S. PATENT DOCUMENTS 9,357,289 B2 5/2016 Lin
9,571,917 B2 2/2017 Litovsky et al.
(Continued)

FOREIGN PATENT DOCUMENTS

GB 2517486 A 2/2015
WO 2018022824 A1 2/2018
WO 2019138782 A1 7/2019

OTHER PUBLICATIONS

Unpublished U.S. Appl. No. 15/878,926, filed Jan. 24, 2018 entitled "Flexible Acoustic Waveguide Device"; Applicant Bose Corporation.

(Continued)

*Primary Examiner* — Vivian C Chin
*Assistant Examiner* — Ammar T Hamid
(74) *Attorney, Agent, or Firm* — Brian M. Dingman; Dingman IP Law, PC

(57) ABSTRACT

An acoustic device with a housing that is configured to be worn draped over the shoulders of a user in a deployed configuration. The housing includes an intermediate portion with opposed first and second ends, a first leg portion that depends from the first end of the intermediate portion, and a second leg portion that depends from the second end of the intermediate portion, wherein each leg portion comprises a distal end spaced farthest from the intermediate portion. The two leg portions can be essentially identical. An acoustic driver is carried by each leg portion and is configured to project sound outwardly from the housing. An acoustic waveguide is located entirely in each leg portion. A waveguide is acoustically coupled to each driver. A waveguide outlet is located in the same leg as the driver and its associated waveguide. The outlets are configured to project outwardly from the housing sound from the driver that was acoustically coupled to the waveguide. Each waveguide extends from the driver, along the leg portion to proximate the intermediate portion, and then turns and extends back along the leg portion to the waveguide outlet.

20 Claims, 7 Drawing Sheets

(51) Int. Cl.

| | |
|---|---|
| ***H04R 3/04*** | (2006.01) |
| ***H04R 3/12*** | (2006.01) |
| ***G10K 11/26*** | (2006.01) |
| *H04R 1/02* | (2006.01) |

(58) Field of Classification Search
USPC ..... 381/74, 338, 345, 374, 333
See application file for complete search history.

(56) References Cited

U.S. PATENT DOCUMENTS

| | | | | |
|---|---|---|---|---|
| 9,654,867 | B2 | 5/2017 | Litovsky et al. | |
| 2016/0066078 | A1* | 3/2016 | Baek | G06F 1/163 381/74 |
| 2016/0255431 | A1* | 9/2016 | Litovsky | H04R 5/0335 381/334 |
| 2016/0337747 | A1 | 11/2016 | Litovsky et al. | |
| 2017/0111733 | A1 | 4/2017 | Litovsky et al. | |
| 2018/0167710 | A1 | 6/2018 | Silver et al. | |

OTHER PUBLICATIONS

Unpublished U.S. Appl. No. 15/594,923, filed May 15, 2017 entitled "Acoustic Device"; Applicant Bose Corporation.
The International Search Report and the Written Opinion of the International Searching Authority dated Oct. 14, 2019 for PCT/US2019/041216.

* cited by examiner

ACOUSTIC DEVICE

BACKGROUND

This disclosure relates to an acoustic device.

Wearable personal audio devices, such as acoustic devices that are designed to be worn draped over the shoulders and provide sound to the ears, are generally relatively large, generally "U"-shaped structures. Some of these devices include two audio transducers and two audio waveguides, where each waveguide is acoustically coupled to one transducer and runs through most of the structure. Since the structure should be flexible so it can be comfortably placed around the neck and over the shoulders, one result is that the device mechanical design and construction must accommodate waveguides that can be flexed. Such devices are thus relatively mechanically complex and difficult and expensive to manufacture.

SUMMARY

All examples and features mentioned below can be combined in any technically possible way.

In one aspect, an acoustic device includes a housing that is configured to be worn draped over the shoulders of a user in a deployed configuration, the housing comprising an intermediate portion with opposed first and second ends, a first leg portion that depends from the first end of the intermediate portion, and a second leg portion that depends from the second end of the intermediate portion. Each leg portion comprises a proximal end that is coupled to the intermediate portion and a distal end spaced farthest from the intermediate portion. A first acoustic driver is carried by the first leg portion and is configured to project sound outwardly from the housing. A first acoustic waveguide is located entirely in the first leg portion and is acoustically coupled to the first acoustic driver. A first acoustic waveguide outlet is located in the first leg portion and is configured to project outwardly from the housing sound from the first acoustic driver that was acoustically coupled to the first acoustic waveguide. The first acoustic waveguide extends from the first acoustic driver, proximally along the first leg portion to proximate the intermediate portion, and then turns and extends distally along the first leg portion to the first acoustic waveguide outlet. A second acoustic driver is carried by the second leg portion and is configured to project sound outwardly from the housing. A second acoustic waveguide is located entirely in the second leg portion and is acoustically coupled to the second acoustic driver. A second acoustic waveguide outlet is located in the second leg portion and is configured to project outwardly from the housing sound from the second acoustic driver that was acoustically coupled to the second acoustic waveguide. The second acoustic waveguide extends from the second acoustic driver, proximally along the second leg portion to proximate the intermediate portion, and then turns and extends distally along the second leg portion to the second acoustic waveguide outlet.

Embodiments may include one of the following features, or any combination thereof. The intermediate portion may be configured to allow relative movement of the first and second leg portions. The first acoustic driver may be proximate the first acoustic waveguide outlet, and the second acoustic driver may be proximate the second acoustic waveguide outlet. The first acoustic driver may be proximate the distal end of the first leg portion, and the second acoustic driver may be proximate the distal end of the second leg portion. The first acoustic waveguide outlet may be closer to the intermediate portion than is the first acoustic driver, and the second acoustic waveguide outlet may be closer to the intermediate portion than is the second acoustic driver.

Embodiments may include one of the above and/or below features, or any combination thereof. The acoustic device may further comprise an audio signal control system that directs audio signals to each of the first and second drivers, where the drivers transduce the audio signals to output sound. The audio signal control system may be configured to apply first and second equalization modes to the audio signals in a first and second listening mode, respectively, wherein the first equalization mode is designed for use in the first listening mode where the housing is draped over the shoulders of the user, and the second equalization mode is designed for use in the second listening mode where the housing is off the shoulders of the user, and where the second equalization mode de-emphasizes frequencies below a first threshold frequency and boosts frequencies above the first threshold frequency. The first threshold frequency may comprise a frequency in a range of about 100-200 Hz. The first equalization mode may de-emphasize frequencies below a second threshold frequency, where the second threshold frequency is below the first threshold frequency. The first listening mode may comprise a personal listening mode. The second listening mode may comprise an out-loud listening mode, wherein the acoustic device is operated while placed somewhere other than on a user's body. In the first listening mode the first and second acoustic drivers may be operated out of phase and in the second listening mode the first and second acoustic drivers may be operated in phase. The first acoustic waveguide may have a first fundamental frequency and the second acoustic waveguide may have a second fundamental frequency, and the second equalization mode may result in effectively no sound pressure level at frequencies below the first and second fundamental frequencies. The audio signal control system may be arranged to drive the first and second acoustic drivers out of phase.

Embodiments may include one of the above and/or below features, or any combination thereof. The first acoustic driver may be configured to radiate sound from both a driver front and a driver back, and the second acoustic driver may be configured to radiate sound from both a driver front and a driver back. The housing may further comprise a first back acoustic volume that is acoustically coupled to the back of the first acoustic driver and is between the first acoustic driver and the first acoustic waveguide, wherein the first back acoustic volume comprises an air-adsorbing material and the housing may further comprise a second back acoustic volume that is acoustically coupled to the back of the second acoustic driver and is between the second acoustic driver and the second acoustic waveguide. The second back acoustic volume may comprise an air-adsorbing material. The acoustic device may further comprise an open-cell foam that carries the air-adsorbing material.

Embodiments may include one of the above and/or below features, or any combination thereof. The first acoustic driver may be configured to radiate sound from both a driver front and a driver back, and the second acoustic driver may be configured to radiate sound from both a driver front and a driver back. The housing may further comprise a first back acoustic volume that is acoustically coupled to the back of the first acoustic driver and is between the first acoustic driver and the first acoustic waveguide and the housing may further comprise a second back acoustic volume that is acoustically coupled to the back of the second acoustic driver and is between the second acoustic driver and the second acoustic waveguide. A fundamental frequency of the first and second waveguides may be less than 100 Hz.

In another aspect, an acoustic device includes a housing that is configured to be worn draped over the shoulders of a user in a deployed configuration, the housing comprising an intermediate portion with opposed first and second ends, a first leg portion that depends from the first end of the intermediate portion, and a second leg portion that depends from the second end of the intermediate portion. Each leg portion comprises a proximal end that is coupled to the intermediate portion and a distal end spaced farthest from the intermediate portion. A first acoustic driver is carried by the first leg portion and is configured to project sound outwardly from the housing. A first acoustic waveguide is located entirely in the first leg portion and is acoustically coupled to the first acoustic driver. A first acoustic waveguide outlet is located in the first leg portion and is configured to project outwardly from the housing sound from the first acoustic driver that was acoustically coupled to the first acoustic waveguide. The first acoustic waveguide extends from the first acoustic driver, proximally along the first leg portion to proximate the intermediate portion, and then turns and extends distally along the first leg portion to the first acoustic waveguide outlet. A second acoustic driver is carried by the second leg portion and is configured to project sound outwardly from the housing. A second acoustic waveguide is located entirely in the second leg portion and is acoustically coupled to the second acoustic driver. A second acoustic waveguide outlet is located in the second leg portion and is configured to project outwardly from the housing sound from the second acoustic driver that was acoustically coupled to the second acoustic waveguide. The second acoustic waveguide extends from the second acoustic driver, proximally along the second leg portion to proximate the intermediate portion, and then turns and extends distally along the second leg portion to the second acoustic waveguide outlet. The first acoustic driver is proximate the first acoustic waveguide outlet, and the second acoustic driver is proximate the second acoustic waveguide outlet. An audio signal control system directs audio signals to each of the first and second drivers, where the drivers transduce the audio signals to output sound. The audio signal control system is configured to apply first and second equalization modes to the audio signals in a first and second listening mode, respectively. In the first listening mode the first and second acoustic drivers are operated out of phase and in the second listening mode the first and second acoustic drivers are operated in phase.

Embodiments may include one of the above and/or below features, or any combination thereof. The first acoustic driver may be configured to radiate sound from both a driver front and a driver back. The second acoustic driver may be configured to radiate sound from both a driver front and a driver back. The housing may further comprise a first back acoustic volume that is acoustically coupled to the back of the first acoustic driver and is between the first acoustic driver and the first acoustic waveguide. The housing may further comprise a second back acoustic volume that is acoustically coupled to the back of the second acoustic driver and is between the second acoustic driver and the second acoustic waveguide. A fundamental frequency of the first and second waveguides may be less than 100 Hz. The first back acoustic volume may comprise an air-adsorbing material and the second back acoustic volume may comprise an air-adsorbing material.

DETAILED DESCRIPTION

Figure 1A:
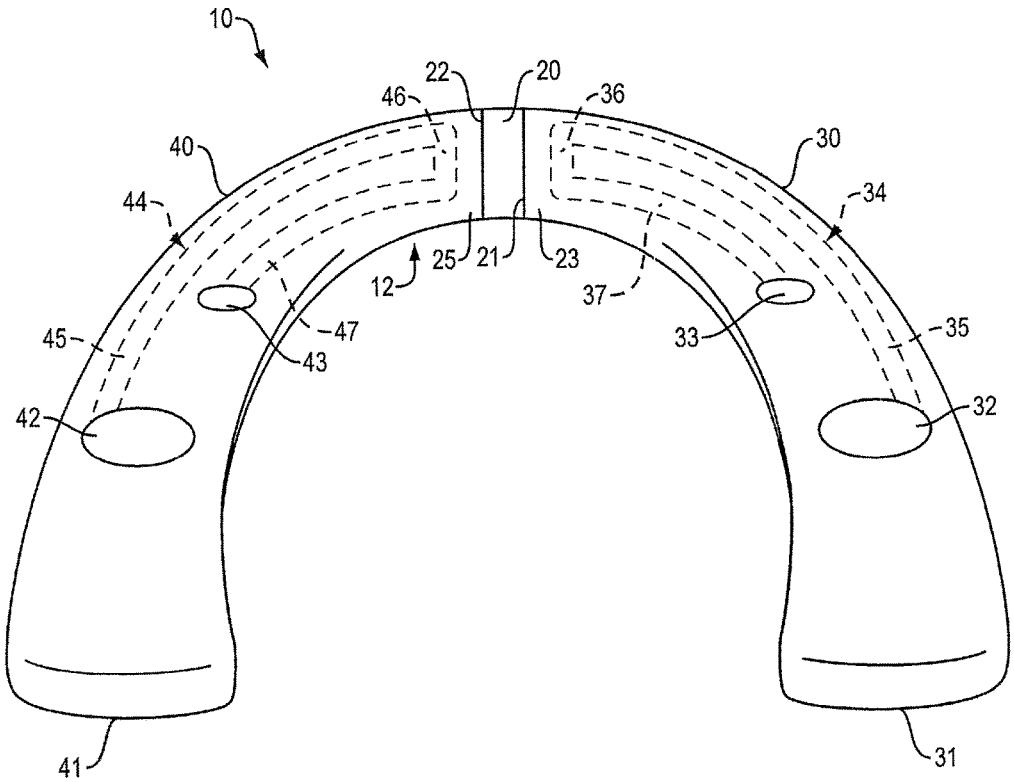
FIG. 1A is a top view of an acoustic device.

The present acoustic device may be of a type that is designed to be worn draped over the shoulders, with audio drivers located on each side of the device, generally below the ears. The back of each driver is acoustically coupled to an acoustic waveguide, with one waveguide per driver. The waveguides help to boost low-frequency sound. The waveguides also help to reduce sound spillage that may be bothersome to other people located nearby the device wearer. The structure is generally "U"-shaped, with an intermediate portion that is configured to pass behind the neck and right and left legs that are configured to drape over the shoulders. Examples of such acoustic devise are disclosed in the patents and applications that are incorporated herein by reference.

The device can be constructed and arranged such that one driver and its associated waveguide is entirely located in one leg of the device and the other driver and its associated waveguide is entirely located in the other leg of the device. The intermediate portion can have some flexibility, to allow relative movement between the legs so that the acoustic device can be comfortably placed around the neck and over the shoulders. In part because the waveguides do not overlap, this construction makes the housing and the waveguides easier to construct than in similar devices where the waveguides run side-by-side through much of the device, including the intermediate portion. Also, since the waveguides do not run side-by-side anywhere in the device, there is less chance for acoustic cross-coupling. Sound quality can thus be improved.

Elements of one or more figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another or may be physically separate. One element may perform the actions of more than one block. Audio signals may be encoded or not and may be transmitted in either digital or analog form. Conventional audio signal processing equipment and operations are in some cases omitted from the drawing.

Figure 1B:
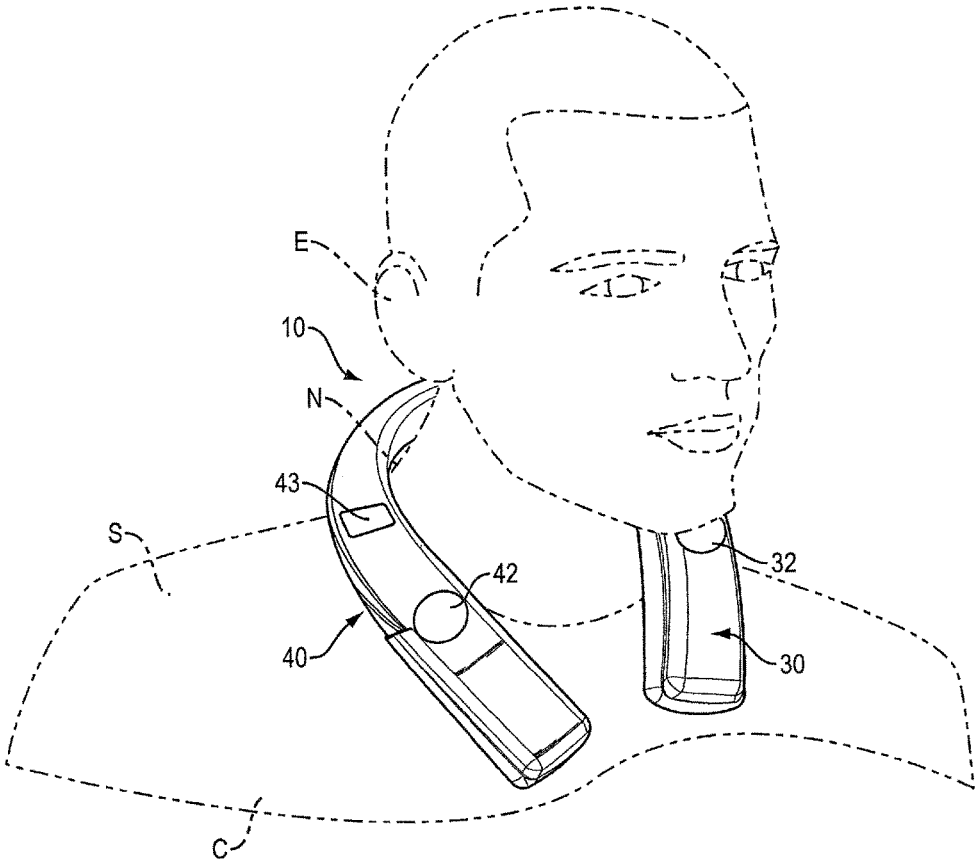
FIG. 1B illustrates the acoustic device of FIG. 1A being worn by a user.

FIGS. 1A and 1B illustrate aspects of one non-limiting example of an acoustic device 10. Acoustic device 10 is configured to be worn draped over the shoulders of a user in a deployed configuration. A deployed configuration of device 10 is shown in FIG. 1B. Device housing 12 can comprise an intermediate portion 20 with opposed first end 21 and second end 22. A first (left) leg portion 30 has proximal end 23 that is coupled to intermediate portion 20. Leg portion 30 depends from the first end 21 of the intermediate portion. A second (right) leg portion 40 has proximal end 25 that is coupled to intermediate portion 20. Leg portion 40 depends from the second end 22 of the intermediate portion. Leg portion 30 has distal end 31 and leg portion 40 has distal end 41, where the distal ends are spaced farthest from intermediate portion 20. The housing portions are not necessarily physically separate parts of the housing. In one example, set forth in more detail below, housing 20 is of a largely unitary construction in which the intermediate portion and the two leg portions are not separate portions of the housing but rather are designated parts of a generally unitary housing.

A first acoustic driver 32 is carried by first leg portion 30. Driver 32 is configured to project sound outwardly from the housing. There is a first acoustic waveguide 34 that is located entirely in the first leg portion. Waveguide 34 is acoustically coupled to driver 32. In this non-limiting example, driver 32 radiates from both its front side and its rear side, and waveguide 34 is acoustically coupled to the rear side of driver 32. There is a first acoustic waveguide outlet 33 that is also located in the first leg portion. Outlet 33 is configured to project outwardly from the housing sound from first acoustic driver 32 that was acoustically coupled to first acoustic waveguide 34. First acoustic waveguide 34 (shown in phantom because it is below the exterior surface of housing 20) runs from first acoustic driver 32 along its first portion 35 that extends along first leg portion 30, proximally to proximate intermediate portion 20. Waveguide 34 then turns into short connecting portion 36 that traverses much of the width of leg 30, and then runs distally back down along first leg portion 30 toward end 31 via the waveguide's final portion 37, to first acoustic waveguide outlet 33 where sound pressure carried by waveguide 34 can exit into the environment. Waveguide 34 is thus located entirely within leg 30 rather than in both legs, but still has a length and a cross-sectional area that allow it to function as an acoustic waveguide. Locating the driver and the waveguide outlet near leg distal end 31 allows the waveguide length to be maximized for a given leg size. In one non-limiting example, waveguide 34 is about 30 cm long, has a cross-sectional area of about 0.5 $cm^2$, and a fundamental frequency of about 70 Hz.

In the non-limiting example depicted in FIGS. 1A and 1B, acoustic device 10 is bilaterally symmetric about intermediate portion 20. Thus, the construction and arrangement of second leg portion 40 is essentially identical to that of first leg portion 30. A second acoustic driver 42 is carried by second leg portion 40. Driver 42 is configured to project sound outwardly from the housing. There is a second acoustic waveguide 44 that is located entirely in the second leg portion. Waveguide 44 is acoustically coupled to driver 42. In this non-limiting example, driver 42 radiates from both its front side and its rear side, and waveguide 44 is acoustically coupled to the rear side of driver 42. There is a second acoustic waveguide outlet 43 that is also located in the second leg portion. Outlet 43 is configured to project outwardly from the housing sound from second acoustic driver 42 that was acoustically coupled to second acoustic waveguide 44. Second acoustic waveguide 44 (shown in phantom because it is below the exterior surface of housing 20) runs from second acoustic driver 42 along its first portion 45 that extends along second leg portion 40, proximally to proximate intermediate portion 20. Waveguide 44 then turns into short connecting portion 46, and then runs distally back down along second leg portion 40 via the waveguide's final portion 47, to second acoustic waveguide outlet 43 where sound pressure carried by waveguide 44 can exit into the environment. Waveguide 44 is thus located entirely within leg 40 rather than in both legs, but still has a length and a cross-sectional area that allow it to function as an acoustic waveguide. Locating the driver and the waveguide outlet near leg distal end 41 allows the waveguide length to be maximized for a given leg size. In one non-limiting example, waveguide 44 is about 30 cm long, has a cross-sectional area of about 0.5 $cm^2$, and a fundamental frequency of about 70 Hz.

Since the construction of legs 30 and 40 is the same—except possibly for them being mirror images of one another—the tooling and manufacturing process for the two legs is essentially identical, which simplifies production and reduces production costs. Also, any relative movement between the two legs (e.g., relative movement that is desired or needed to allow the user to don and doff the audio device) can if desired be accommodated in intermediate portion 20, e.g., by making intermediate portion 20 somewhat flexible. Thus, the two legs do not need to be designed or constructed to have flexibility, which further simplifies production and reduces production costs as compared to similar audio devices in which the legs are designed and constructed so that they can be flexed or bent. Also, fully independent left and right waveguides (e.g., with no cross-talk between them) allows for greater flexibility in audio design and signal processing.

Figure 3:
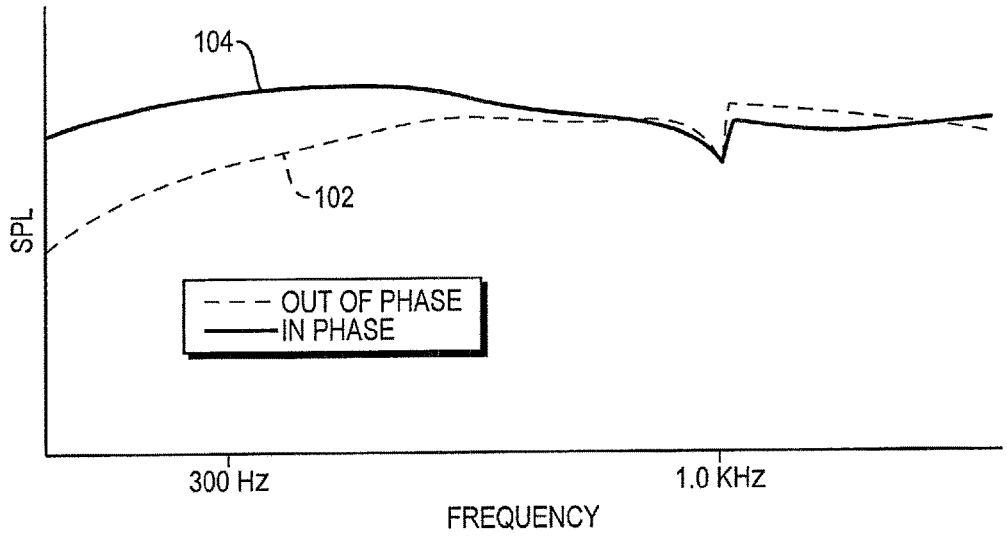
FIG. 3 is a plot of frequency vs. sound pressure level (SPL) for two different equalization modes of operation of an acoustic device.

When the audio device is worn on the body, the left and right channels can in one non-limiting example be operated out of phase at all frequencies. This reduces sound spillage as compared to similar audio devices where sound is played in phase (at least over some of the frequency range). An improvement in spillage of up to about 3 to 10 dB is expected, with a reduction at the ears (due to cancellation) of only about 0.5 dB. An example is shown in FIG. 3, which is a plot of frequency v. far-field power (SPL) for an acoustic device such as shown in FIGS. 1A and 1B with the two transducers spaced 20 cm apart, approximately as they would be when the device is worn on the body as shown in FIG. 1B. As can be seen, operating the transducers out of phase (curve 102) reduces spillage at frequencies up to about 900 Hz as compared to the transducers being operated in-phase (curve 104). Operating the two transducers out of phase also makes the sound seem more spacious to the wearer/listener, as compared to sound that is in-phase to the left and right ears. Also, since the two waveguides never exist close to one another (e.g., they never run side-by-side), there is less or no cross-coupling between the waveguides. This reduces the need for construction and materials that are aimed to prevent or reduce cross coupling, which can simplify the product design and decrease the device weight and production costs.

When device 10 is in the deployed position each driver (32, 42) may be located generally below the expected location of an ear "E" as shown in FIG. 1B. Device 10 sits on the shoulders "S" and upper chest "C," and extends behind neck "N." Also, in one example, the rear of each driver radiates into an acoustic waveguide, with the outlets of the waveguides in the same leg that carries the driver. So, driver 42 is carried by right leg 40, and the right driver waveguide outlet 43 is in right leg 40, generally proximate driver 42 and generally below the expected location of the right ear. Left-side driver 32 is carried by left leg 30 and its waveguide outlet 33 is in left leg 30, generally proximate driver 32 and generally below left ear E. Each ear thus receives sound pressure both directly from the front of one transducer, and, via a waveguide, from the back of the same transducer. Of course, some sound from the left side reaches the right ear and vice-versa, as is the case with any open audio device.

Figure 2:
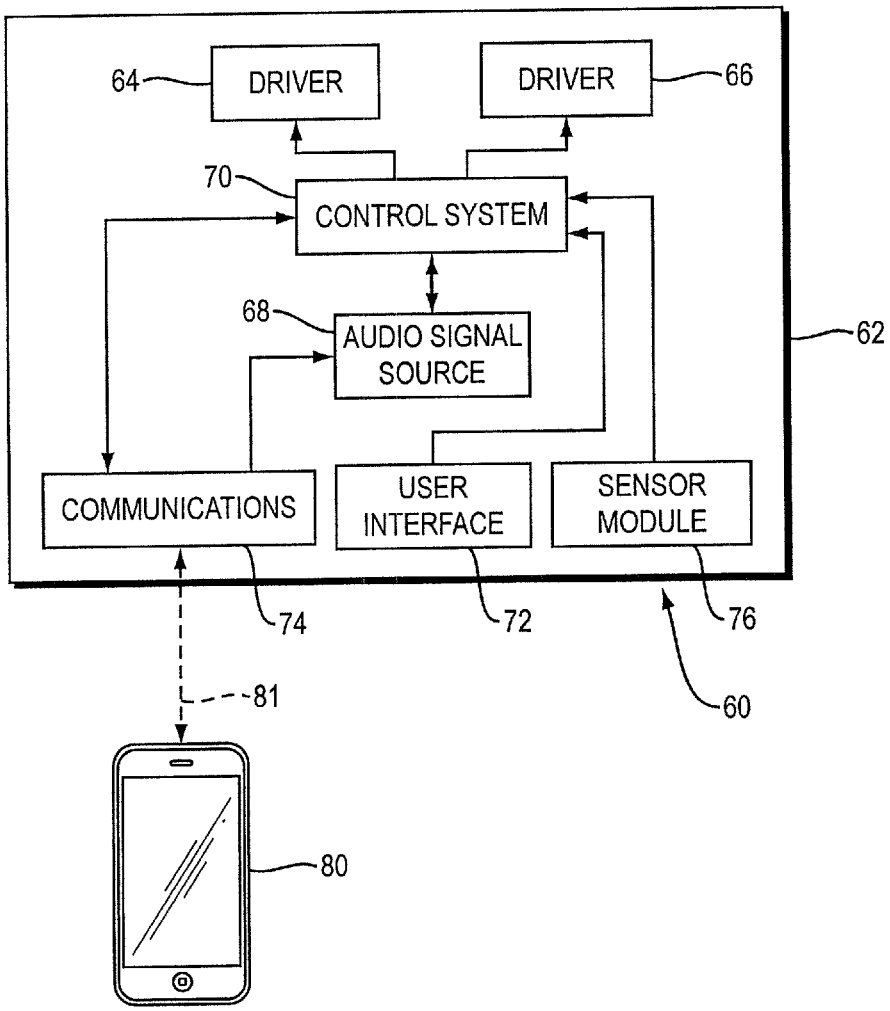
FIG. 2 is a functional block diagram of an acoustic device.

FIG. 2 is a schematic functional diagram of an acoustic device 60. Acoustic device 60 includes a housing 62. Housing 62 carries at least two acoustic drivers (transducers), 64 and 66. In some non-limiting examples herein device 60 is a shoulder-wearable audio device that is adapted to convey audio to the wearer's ears while in one listening mode minimizing audio spilled to others nearby the user. However, this disclosure is not limited to a shoulder-wearable audio device and includes other audio devices such as on-ear, in-ear, and off-ear headphones and other portable devices with at least two drivers. All of the electrical and electronic components of device 60 could be powered by a rechargeable battery, not shown.

Audio signal source 68 provides audio signals that are transduced by drivers 64 and 66. The audio signals can be present in memory (not shown) in device 60, and/or can be provided to device 60 by one or more separate audio source devices, as is known in the field. One example of a separate audio source is portable device 80 (e.g., a smartphone or a tablet), which is adapted to communicate with device 60 as indicated by connection 81 between portable device 80 and communications module 74 of device 60. Such communication can be wired, or wireless, as is known in the field.

If acoustic device 60 is designed to be worn draped over the shoulders, with loudspeakers located on each side of the device, below or proximate the ears, audio signal control system 70 may be adapted to process audio signals so as to produce sound at a relatively low amplitude and equalized to reduce spillage. Spillage reduction generally occurs best when the left-side and right-side transducers are played out of phase. This leads to some destructive interference and thus sound cancellation in the far field, as is known in the art. Device 60 can, of course, be taken off the body and used as a portable out-loud speaker. In order for device 60 to produce sound at a sufficient amplitude when used as a portable speaker this way, control system 70 can implement two (or more) equalizations, a first equalization designed for the personal use mode (where the device is worn on the shoulders), and a second equalization designed for the out-loud listening mode. In the out-loud mode, control system 70 can apply an equalization that de-emphasizes low-frequency content as compared to the personal use mode. In the out-loud mode, control system 70 may also apply an equalization that provides additional gain to the mid and high-frequency content so that the acoustic device has sufficient volume to be heard out-loud. In one non-limiting example, the out-loud equalization accomplishes both reduced low-frequency energy and increased energy at mid and high frequencies. Also, control system 70 can be enabled to create an equalization in which the two drivers are operated in-phase in order to increase spillage. This equalization can be enabled either while the audio device is worn on the body or while the device is located off the body. This equalization allows the user to better share the sound with others located nearby.

In one example of the acoustic device, the two drivers are driven out of phase at all frequencies. The out of phase operation results in far-field sound cancellation and thus less sound spillage. When an acoustic device with drivers driven out of phase is used for out-loud listening, since the low frequencies are cancelled in the far field the user is not obtaining the benefit of the low frequency sound. Thus, the acoustic device can save power in the out-loud mode (if the transducers are played out of phase) by not playing, or at least de-emphasizing low frequencies.

In order to satisfactorily provide for the multiple equalization modes, acoustic device 60 can have a mechanism that either automatically or manually switches between the modes. Manual switching can be accommodated via user interface 72 (e.g., with a physical switch), or via a user-operable equalization switching control on an application ("app") on remote device 80 that communicates with control system 70 through communications module 74. Other means of accomplishing manual switching are contemplated. Automatic switching can be accommodated using sensor module 76 that communicates with control system 70. Sensor module 76 could be a switch that is engaged when device 60 is placed on a hard surface (e.g., a contact switch), or it could be a body sensor (e.g., a temperature sensor, an IR sensor, or a capacitive sensor) that senses when the device is being worn on the human body, or not. Another alternative would be an inertial sensor (e.g., a MEMS accelerometer/gyroscope device) or another sensor that detects motion, since small or large motions (e.g., from breathing, moving the torso, or walking) would be likely to occur when the device is worn over the shoulders.

Switching between equalization modes may in some non-limiting examples accommodate some form of time constant or delay, to ease the transition between modes. For example, if the device is switched from out-loud mode to personal mode, the volume should be reduced immediately because the drivers will be within inches of the ear and the high sound pressure level (SPL) of the out-loud mode could be uncomfortable. In contrast, at least for the expected few seconds after the device is taken off the shoulders and is placed on a table or another surface for out-loud listening, the SPL should either not increase or perhaps should increase gradually, to avoid a high SPL at the ears. Any time delay, from zero on up, is contemplated. Time delays and gradual volume changes/equalization changes, can be accomplished using control system 70.

Figure 4:
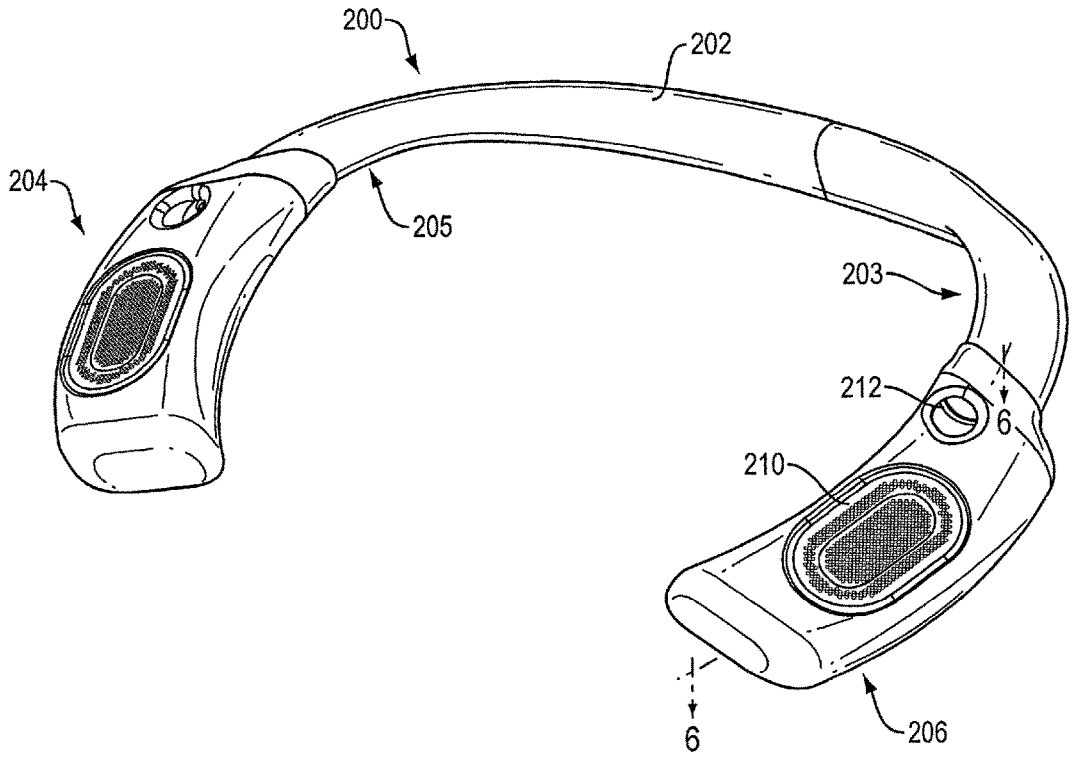
FIG. 4 is a perspective view of an acoustic device.
Figure 5:
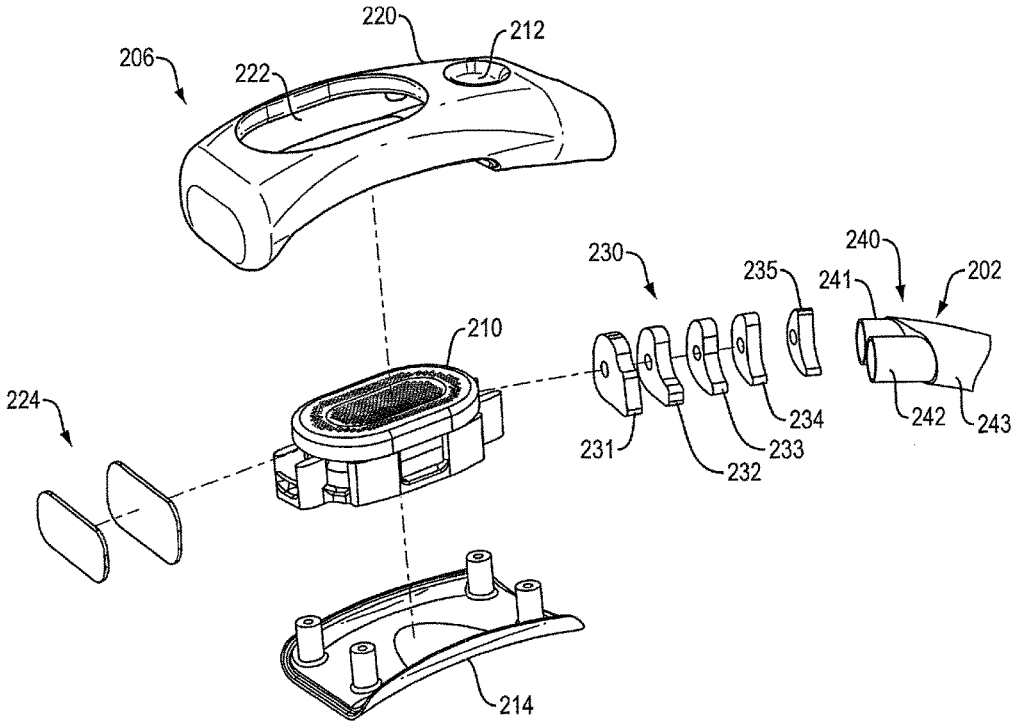
FIG. 5 is an exploded view of an acoustic pod of the acoustic device of FIG. 4.
Figure 6:
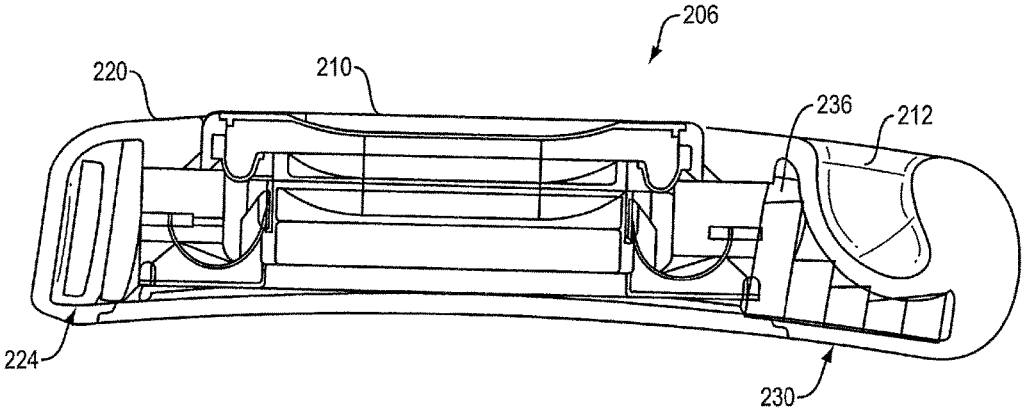
FIG. 6 is a cross-sectional view taken along line 6-6, FIG. 4.

FIGS. 4-6 illustrate another audio device 200. Acoustic pods 204 and 206 are carried at the opposed ends of intermediate portion 202. Intermediate portion 202 may house two waveguides, one for each of the left side 203 and right side 205 of device 200. In one non-limiting example, the waveguides can be flexible waveguides, such as those disclosed in U.S. patent application Ser. No. 15/878,926, filed on Jan. 24, 2018, entitled "Flexible Acoustic Waveguide Device," the disclosure of which is incorporated herein by reference. Flexible waveguides can make the intermediate portion 202 flexible, which can allow it to be bent or curved by the user in order to reduce the size of acoustic device 200, e.g., for storage.

Each acoustic pod 204, 206, is a construction that includes a driver and a waveguide outlet. Pods are one non-limiting manner of providing a driver and a waveguide outlet and waveguide terminations, but other structures can be used to achieve these results. Acoustic pod 206 is illustrated in some detail in FIGS. 5 and 6. Acoustic pod 206 includes housing 220 with opening 222 that receives driver module 210 and opening 212 that comprises the waveguide outlet opening.

Driver module 210 fits into opening 222 and includes a driver and a housing that carries the driver and accommodates the necessary electrical connections to printed circuit board(s) 224 that carry the electronics needed to receive and play audio signals. The first portion of waveguide 240 is portion 242, which is acoustically coupled to the back of the driver. The final portion of waveguide 240 is portion 241 that is acoustically coupled to waveguide outlet 212. Waveguide 240 can be covered by cover 243, which may be a fabric or a plastic cover, for example. Cap 214 holds module 210 in housing 220 and is fixed to housing 220 by screws or other fasteners in this example.

The sound pressure from the rear of the driver is acoustically coupled to rear acoustic cavity 236, which is formed in housing 220. See FIG. 6. The outlet of cavity 236 is acoustically coupled to first waveguide portion 242. The volume of rear cavity 236 may be about 20 to 40 $mm^3$. Cavity 236 effectively increases the volume of the waveguide. The increased waveguide volume leads to a lower waveguide fundamental frequency, which can increase the acoustic efficiency of the device. In order to increase the apparent volume of the rear cavity and thus increase the apparent volume of the waveguide, air adsorbing material 230 such as that disclosed in U.S. Pat. No. 9,357,289 and its related patents, all incorporated by reference herein, can be placed into cavity 236. As one non-limiting example, an air-adsorbing material can increase the apparent volume by up to about three times. Thus, a 20 $cm^3$ cavity half filled with a foam carrying an air-adsorbing material can have an equivalent volume of 40 $cm^3$ (10 $cm^3$ air plus 10 $cm^3$ foam that is equivalent to 30 $cm^3$ air). The use of the air-adsorbing material can thus increase the apparent volume of a particular cavity, or it can allow a smaller cavity to have an apparent volume of a much larger cavity.

Increasing the apparent volume of the rear cavity decreases the tuning frequency of the waveguide, which can further boost low frequency sounds and/or increase the efficiency of the audio device. In this non-limiting example, the air-adsorbing material 230 is in the form of pieces of open-cell foam that carries air-adsorbing material, as disclosed in U.S. Pat. No. 9,357,289 and its related patents. The material is shown as five separate shaped pieces of foam, numbered 231-235. The pieces are shaped and grouped such that they as a whole fill up to about 50% of cavity 236. The fill volume of the cavity can be selected to achieve a needed air flow through the cavity while increasing the apparent volume of the cavity as desired. Typically, a higher apparent volume is more desirable, so the rear cavity will be filled as much as possible with air adsorbing material, while retaining sufficient air volume to accommodate the air flow need for the waveguide. The use of foam, and the use of separate pieces of air-adsorbing material, is not a limitation, as the material can take other forms and shapes. For example, the air-adsorbing material may be a powder that is contained in a container (e.g., a flexible bag) that has openings to allow airflow.

Shoulder-worn acoustic devices of the type shown and described herein are further described in U.S. Pat. Nos. 9,571,917, 9,654,867, U.S. Patent Application Publications 2017/0111733, 2016/0337747, and 2016/0255431, and U.S. patent application Ser. No. 15/594,923, filed on May 15, 2017. The disclosures of each of these patents, publications, and applications are incorporated by reference herein in their entireties.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device, comprising:

a housing that is configured to be worn draped over the shoulders of a user in a deployed configuration, the housing comprising an intermediate portion with opposed first and second ends, a first leg portion that depends from the first end of the intermediate portion, and a second leg portion that depends from the second end of the intermediate portion, wherein each leg portion comprises a proximal end that is coupled to the intermediate portion and a distal end spaced farthest from the intermediate portion;

a first acoustic driver carried by the first leg portion and configured to project sound outwardly from the housing;

a first acoustic waveguide located entirely in the first leg portion and acoustically coupled to the first acoustic driver;

a first acoustic waveguide outlet located in the first leg portion and configured to project outwardly from the housing sound from the first acoustic driver that was acoustically coupled to the first acoustic waveguide;

wherein the first acoustic waveguide extends from the first acoustic driver, proximally along the first leg portion to proximate the intermediate portion, and then turns and extends distally along the first leg portion to the first acoustic waveguide outlet;

a second acoustic driver carried by the second leg portion and configured to project sound outwardly from the housing;

a second acoustic waveguide located entirely in the second leg portion and acoustically coupled to the second acoustic driver; and a second acoustic waveguide outlet located in the second leg portion and configured to project outwardly from the housing sound from the second acoustic driver that was acoustically coupled to the second acoustic waveguide;

wherein the second acoustic waveguide extends from the second acoustic driver, proximally along the second leg portion to proximate the intermediate portion, and then turns and extends distally along the second leg portion to the second acoustic waveguide outlet.

2. The acoustic device of claim 1, wherein the intermediate portion is configured to allow relative movement of the first and second leg portions.

3. The acoustic device of claim 1, wherein the first acoustic driver is proximate the first acoustic waveguide outlet, and the second acoustic driver is proximate the second acoustic waveguide outlet.

4. The acoustic device of claim 3, wherein the first acoustic driver is proximate the distal end of the first leg portion, and the second acoustic driver is proximate the distal end of the second leg portion.

5. The acoustic device of claim 3, wherein the first acoustic waveguide outlet is closer to the intermediate portion than is the first acoustic driver, and the second acoustic waveguide outlet is closer to the intermediate portion than is the second acoustic driver.

6. The acoustic device of claim 1, further comprising an audio signal control system that directs audio signals to each of the first and second drivers, where the drivers transduce the audio signals to output sound.

7. The acoustic device of claim 6, wherein the audio signal control system is configured to apply first and second equalization modes to the audio signals in a first and second listening mode, respectively, wherein the first equalization mode is designed for use in the first listening mode where the housing is draped over the shoulders of the user, and the second equalization mode is designed for use in the second listening mode where the housing is off the shoulders of the user, and where the second equalization mode de-emphasizes frequencies below a first threshold frequency and boosts frequencies above the first threshold frequency.

8. The acoustic device of claim 7, wherein the first threshold frequency comprises a frequency in a range of about 100-200 Hz.

9. The acoustic device of claim 7, wherein the first equalization mode de-emphasizes frequencies below a second threshold frequency, where the second threshold frequency is below the first threshold frequency.

10. The acoustic device of claim 7, wherein the first listening mode comprises a personal listening mode.

11. The acoustic device of claim 10, wherein the second listening mode comprises an out-loud listening mode, wherein the acoustic device is operated while placed somewhere other than on a user's body.

12. The acoustic device of claim 11, wherein in the first listening mode the first and second acoustic drivers are operated out of phase and in the second listening mode the first and second acoustic drivers are operated in phase.

13. The acoustic device of claim 7, wherein the first acoustic waveguide has a first fundamental frequency and the second acoustic waveguide has a second fundamental frequency, wherein the second equalization mode results in effectively no sound pressure level at frequencies below the first and second fundamental frequencies.

14. The acoustic device of claim 6, wherein the audio signal control system is arranged to drive the first and second acoustic drivers out of phase.

15. The acoustic device of claim 1, wherein:

the first acoustic driver is configured to radiate sound from both a driver front and a driver back;

the second acoustic driver is configured to radiate sound from both a driver front and a driver back;

the housing further comprises a first back acoustic volume that is acoustically coupled to the back of the first acoustic driver and is between the first acoustic driver and the first acoustic waveguide, wherein the first back acoustic volume comprises an air-adsorbing material; and the housing further comprises a second back acoustic volume that is acoustically coupled to the back of the second acoustic driver and is between the second acoustic driver and the second acoustic waveguide, wherein the second back acoustic volume comprises an air-adsorbing material.

16. The acoustic device of claim 15, further comprising an open-cell foam that carries the air-adsorbing material.

17. The acoustic device of claim 1, wherein:

the first acoustic driver is configured to radiate sound from both a driver front and a driver back;

the second acoustic driver is configured to radiate sound from both a driver front and a driver back;

the housing further comprises a first back acoustic volume that is acoustically coupled to the back of the first acoustic driver and is between the first acoustic driver and the first acoustic waveguide; and the housing further comprises a second back acoustic volume that is acoustically coupled to the back of the second acoustic driver and is between the second acoustic driver and the second acoustic waveguide;

wherein a fundamental frequency of the first and second waveguides is less than 100 Hz.

18. An acoustic device, comprising:

a housing that is configured to be worn draped over the shoulders of a user in a deployed configuration, the housing comprising an intermediate portion with opposed first and second ends, a first leg portion that depends from the first end of the intermediate portion, and a second leg portion that depends from the second end of the intermediate portion, wherein each leg portion comprises a proximal end that is coupled to the intermediate portion and a distal end spaced farthest from the intermediate portion;

a first acoustic driver carried by the first leg portion and configured to project sound outwardly from the housing;

a first acoustic waveguide located entirely in the first leg portion and acoustically coupled to the first acoustic driver;

a first acoustic waveguide outlet located in the first leg portion and configured to project outwardly from the housing sound from the first acoustic driver that was acoustically coupled to the first acoustic waveguide;

wherein the first acoustic waveguide extends from the first acoustic driver, proximally along the first leg portion to proximate the intermediate portion, and then turns and extends distally along the first leg portion to the first acoustic waveguide outlet;

a second acoustic driver carried by the second leg portion and configured to project sound outwardly from the housing;

a second acoustic waveguide located entirely in the second leg portion and acoustically coupled to the second acoustic driver;

a second acoustic waveguide outlet located in the second leg portion and configured to project outwardly from the housing sound from the second acoustic driver that was acoustically coupled to the second acoustic waveguide;

wherein the second acoustic waveguide extends from the second acoustic driver, proximally along the second leg portion to proximate the intermediate portion, and then turns and extends distally along the second leg portion to the second acoustic waveguide outlet;

wherein the first acoustic driver is proximate the first acoustic waveguide outlet, and the second acoustic driver is proximate the second acoustic waveguide outlet; and an audio signal control system that directs audio signals to each of the first and second drivers, where the drivers transduce the audio signals to output sound, wherein the audio signal control system is configured to apply first and second equalization modes to the audio signals in a first and second listening mode, respectively, wherein in the first listening mode the first and second acoustic drivers are operated out of phase and in the second listening mode the first and second acoustic drivers are operated in phase.

19. The acoustic device of claim 18, wherein:

the first acoustic driver is configured to radiate sound from both a driver front and a driver back;

the second acoustic driver is configured to radiate sound from both a driver front and a driver back;

the housing further comprises a first back acoustic volume that is acoustically coupled to the back of the first acoustic driver and is between the first acoustic driver and the first acoustic waveguide; and the housing further comprises a second back acoustic volume that is acoustically coupled to the back of the second acoustic driver and is between the second acoustic driver and the second acoustic waveguide;

wherein a fundamental frequency of the first and second waveguides is less than 100 Hz.

20. The acoustic device of claim 19, wherein the first back acoustic volume comprises an air-adsorbing material and the second back acoustic volume comprises an air-adsorbing material.

* * * * *